US005201555A

United States Patent [19]

Meyer

[11] Patent Number: 5,201,555

[45] Date of Patent: Apr. 13, 1993

[54] DOGGING MECHANISM

[75] Inventor: Jeffry R. Meyer, Penn Hills Township, Allegheny County, Pa.

[73] Assignee: Westinghouse Electric Corp., Pittsburgh, Pa.

[21] Appl. No.: 669,258

[22] Filed: Mar. 14, 1991

[51] Int. Cl.[5] ..... E05C 9/06

[52] U.S. Cl. ..... 292/48; 292/193; 292/DIG. 60; 292/DIG. 57

[58] Field of Search ..... 292/48, 26, 193, 342, 292/DIG. 57, DIG. 71, 53, 47, DIG. 60

[56] References Cited

U.S. PATENT DOCUMENTS

| | | | |
|---|---|---|---|
| 633,552 | 9/1899 | Kenny | 292/241 |
| 2,128,305 | 8/1938 | Lambert | 292/241 |
| 2,128,439 | 8/1938 | Stinson | 292/48 |
| 2,460,961 | 2/1949 | Wilson | 292/48 |
| 2,493,882 | 1/1950 | Lambert | 292/48 |

*Primary Examiner*—Richard E. Moore

[57] ABSTRACT

A dogging mechanism for a bulkhead door on a ship, which uses a rotatable handle connected to a four bar parallel linkage to pivot a plurality of rollers over a plurality of wedge shaped lugs to tightly close the door and make it water tight when used with a double directional gasket.

6 Claims, 3 Drawing Sheets

DOGGING MECHANISM

GOVERNMENT CONTRACT

This invention was conceived or first reduced to practice in the course of, or under contract number N00024-86-C 4030 between Westinghouse Electric Corporation and the United Stated Government, represented by the Department of the Navy.

CROSS REFERENCE TO RELATED APPLICATIONS

This application is related to a co-pending application entitled Double Directional Gasket and Water Tight Door, both filed on the same day as this application.

BACKGROUND OF THE INVENTION

The invention relates to a dogging mechanism and more particularly to a dogging mechanism with rollers which engage ramps to produce a dogging mechanism which can be operated with a minimum amount of force.

Typical dogging mechanisms used on shipboard water tight doors use flat plate dogs pivoting in a plane parallel to the plane of the door panel, which rotate over the door, sliding over metal wedges attached to the door. These dogs typically operate with high friction loads because of the metal to metal sliding contact. Thus, they operate with high wear rates and must be readjusted frequently to compensate for the wear and high friction loading on the operating linkage. These dogging mechanisms also require high operating forces, which are supplied by long handles, making it difficult for the mechanism to resist shock loads.

SUMMARY OF THE INVENTION

Among the objects of the invention may be noted the provision of a dogging mechanism in which the closing force is low and essentially all of the closing force is directed to dog the closure rather than over come friction.

In general, a dogging mechanism for a closure, when made in accordance with this invention, comprises a plurality of lugs having a ramp portion and a plateau portion, a plurality of links pivotally mounted to cooperate with the lugs, and a connecting bar pivotally connected to said links to form a parallel bar linkage. A roller is rotatably connected to each of the links and disposed to engage the ramp portion of the cooperatively associated lug and roll thereon and onto the plateau portion of the lug as the links are pivoted by the connecting bar. A handle is mounted for rotation and has a link rigidly connected to the handle. An operating bar connects the handle link to the connecting bar to move the parallel bar linkage when the handle is turned and force the closure into a tightly closed position.

BRIEF DESCRIPTION OF THE DRAWINGS

The invention as set forth in the claims will become more apparent by reading the following detailed description in conjunction with the accompanying drawings, wherein like reference numerals refer to like parts throughout the drawings and in which:

DESCRIPTION OF THE PREFERRED EMBODIMENT

Figure 1:
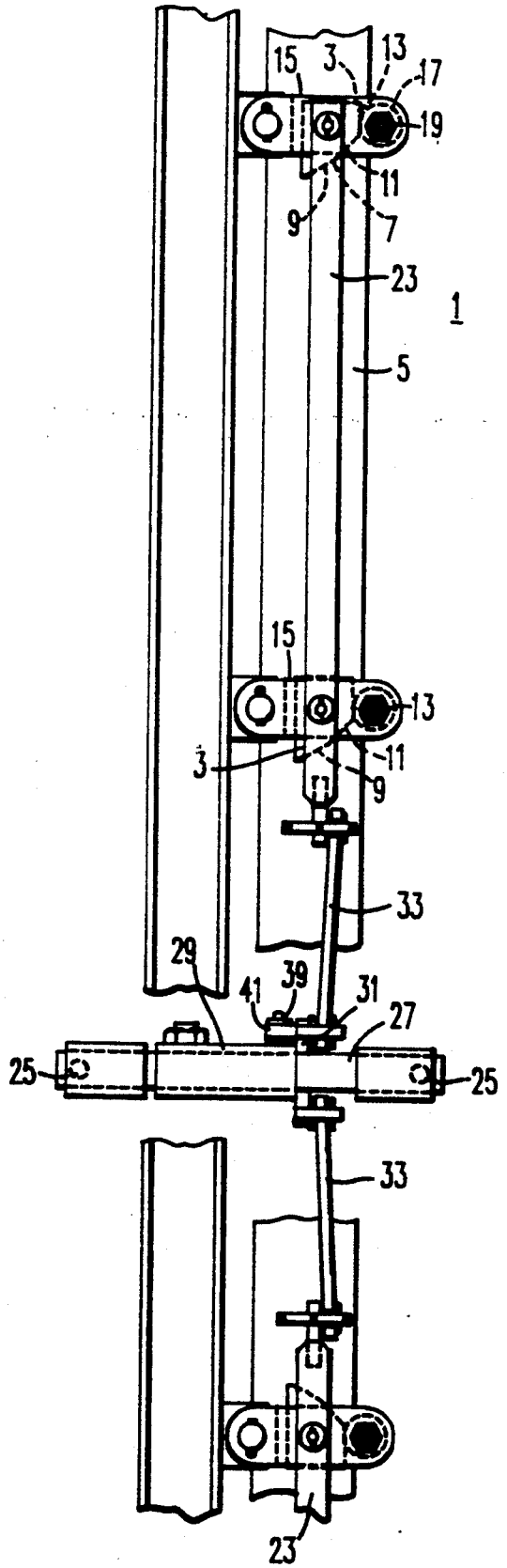
FIG. 1 is a an elevational view of the dogging mechanism with a portion thereof in section.
Figure 2:
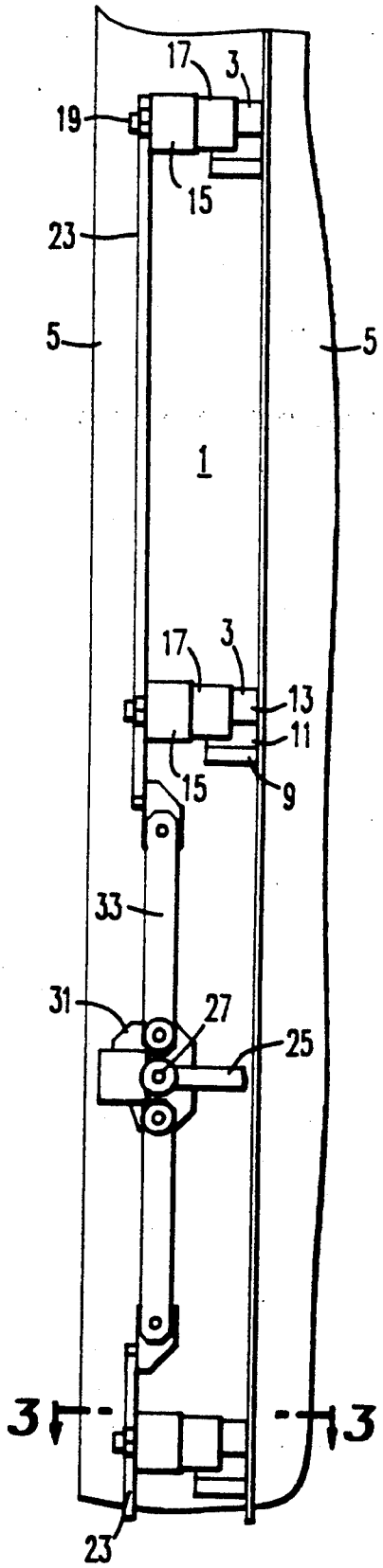
FIG. 2 is a an elevational view of the dogging mechanism.

Referring now to the drawings in detail and in particular to FIG. 1 and 2 there is shown a dogging mechanism 1 for a closure such as a hatch or bulkhead door on a ship. The dogging mechanism comprises a plurality of lugs 3 preferably mounted on the lid or door 5. The lugs 3 have a ramp portion 7 with a plurality of slopes 9 and 11 and a plateau portion 13. The slope portion 11 adjacent the plateau portion 13 is the least steep. Disposed to cooperate with each lug 3 is a pivotally mounted link 15. Each pivotally mounted link 15 has a roller 17 rotatably connected thereto.

Figure 3:
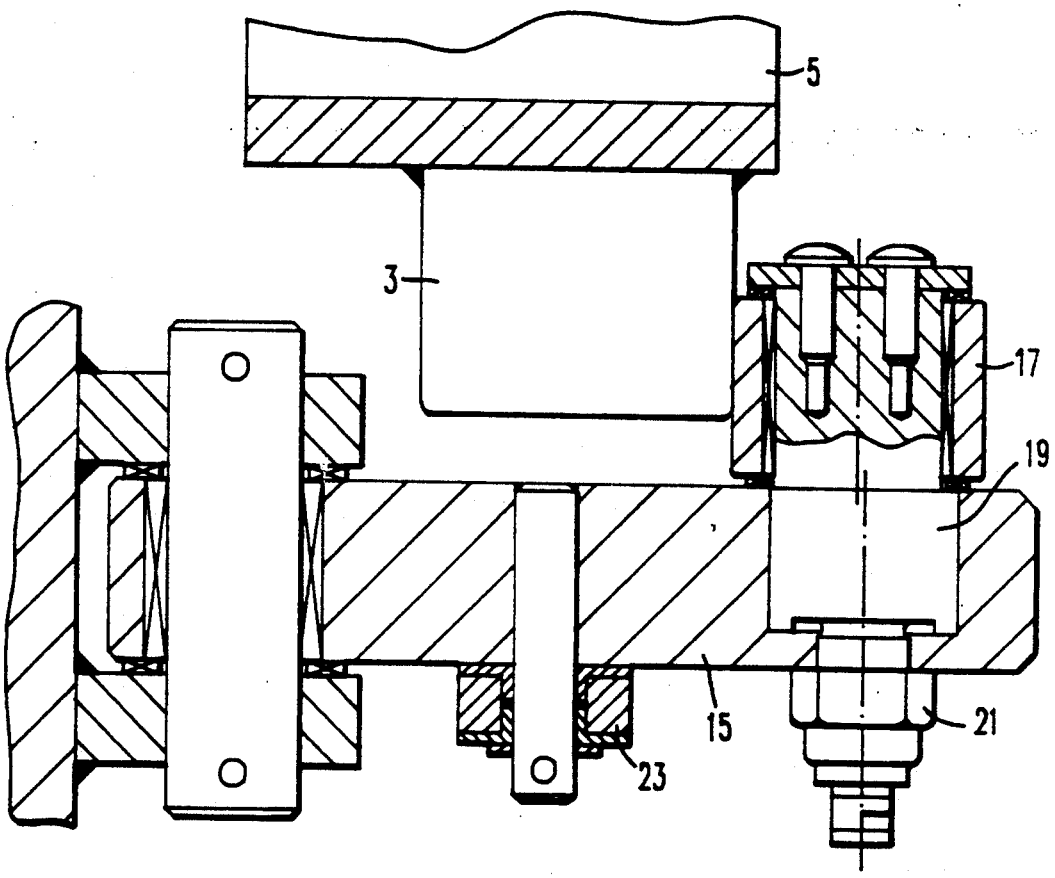
FIG. 3 is an enlarged sectional view taken on line 3—3 of FIG. 2.

As shown in FIG. 3, an eccentric shaft 19 connects the roller 17 to the link 15. The amount of eccentricity is small and, due to the geometry chosen, is self locking. A locking nut 21 is provided and cooperates with the small eccentricity to prevent the eccentric shaft 19 from rotating once it is set. A connecting bar 23 pivotally connects at least two of the links 15 inboard of the roller 17 to form a parallel bar linkage.

Figure 4:
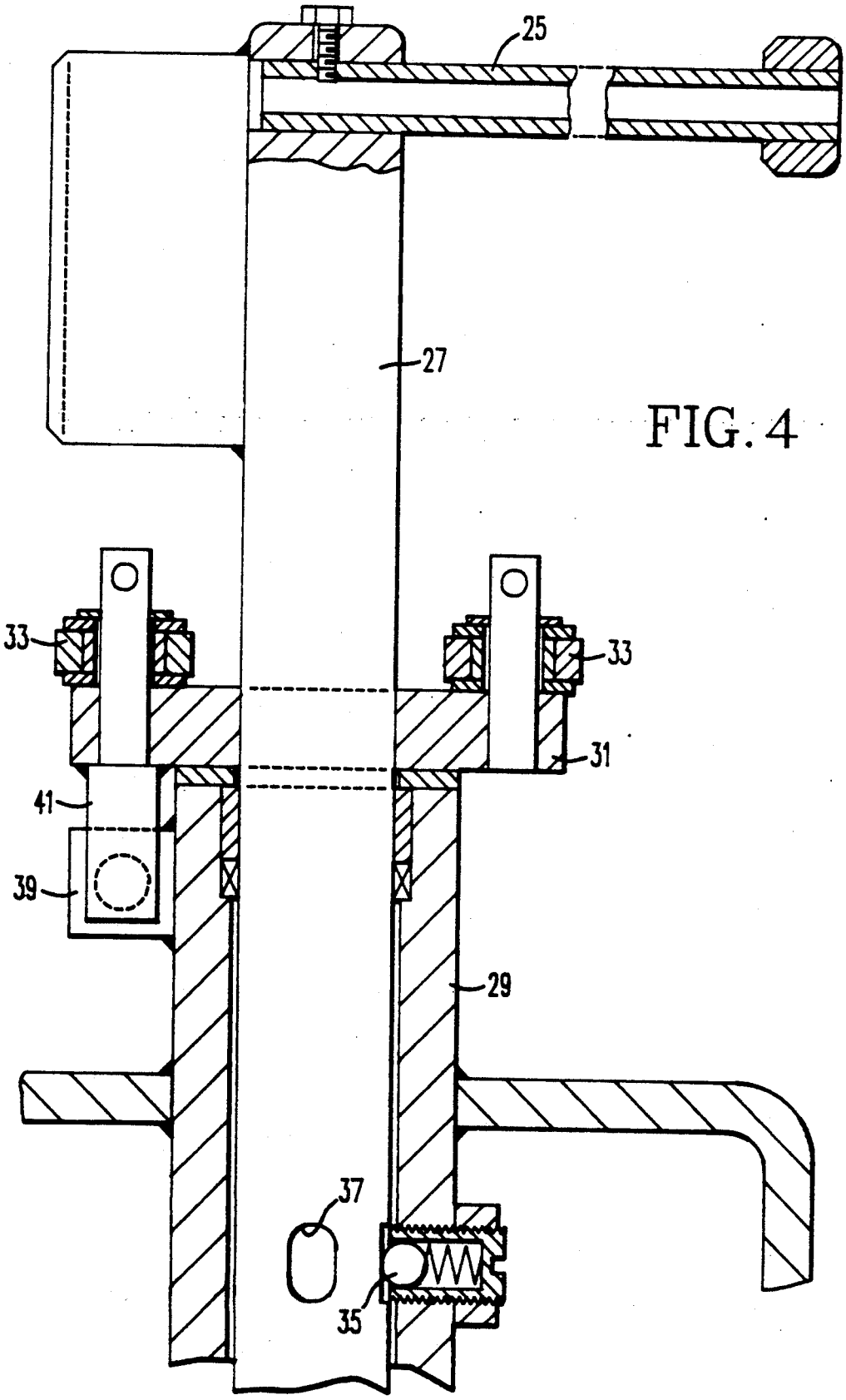
FIG. 4 is an enlarged elevational view of an operating handle.

As shown in FIG. 4, an operating handle 25 is connected to a shaft 27, which is rotatably mounted in a bearing housing 29. A link 31 is rigidly connected to the shaft 27 and handle 25. An operating bar 33 having gimbal like ends pivotally connects the link 31 to the connecting bar 23. The housing 29 has spring loaded detent balls 35, which engage grooves 37 in the shaft 27 to position the handle 25 at two arcuate positions spaced 90° apart. Adjustable stops 39 are disposed on the housing 29 to engage a pin 41 on the link 31 to limit the rotation of the handle 25 to essentially 90°.

The operation of the dogging mechanism 1 begins by rotating the operating handle 25, whereby the links 31 push on the operating and connecting bars 33 and 23 to pivot the links 15. As the links 15 pivot the rollers 17 engage the ramp portion 7 of the cooperatively associated lugs 3 rolling up the slopes 9 and 11 and on to the plateau portion 13 as the operating handle 25 approaches the closed position moving the door or lid 5 in a tightly closed position to form a water tight seal when used with a double directional gasket. The rolling contact between the roller 17 and ramp 7 together with the pivotal and rotational movements of the linkage reduces friction to a minimum so that the majority of the closing force is applied to close the door or lid 5. When in the closed position, the link 15 and roller 17 are in a dead center position and any loading from the ,lug 3 does not produce any force which would tend to operate the mechanism and at the same time the linkage is such that a force on the operating handle 25 transmits a maximum force through the mechanism 1 to either close or open the door 5 making the mechanism 1 easy to operate. The simple toggle linkage at the operating handle 25 can be weight balanced to resist shock and keep the linkage in any position without requiring high frictional loading.

To open the door 5 the operating handle is turned in the opposite direction. The links 31 pull on the operating and connecting bars 33 and 23 to pivot the links 15 causing the rollers 15 to roll off the plateau portion 13 and on to the ramp portion 7 of the lugs 3 and then free of the lugs 3 allowing the door 5 to open.

The dogging mechanism 1 described herein is much simpler, less costly and weighs less than existing systems and yet can apply as much, if not more, load without significant wear and with much less maintenance. The mechanism 1 is easily maintained as there are few elements, all of which are accessible and any portion can be removed without disturbing the other components.

While the preferred embodiments described herein set forth the best mode to practice this invention presently contemplated by the inventor, numerous modifications and adaptations of this invention will be apparent to others skilled in the art. Therefore, the embodiments are to be considered as illustrative and exemplary and it is understood that the claims are intended to cover such modifications and adaptations as they are considered to be within the spirit and scope of this invention.

What is claimed is:

1. A dogging mechanism for a closure, the dogging mechanism comprising a plurality of lugs having a ramp portion and a plateau portion, a plurality of links pivotally mounted to cooperate with the lugs, a connecting bar pivotally connected to said links to form a parallel bar linkage, a roller rotatably connected to each of the links and disposed to engage the ramp portion of a cooperatively associated lug and roll thereon and onto the plateau portion of the cooperatively associated lug as the links are pivoted by the connecting bar, the roller mounted on a shaft having an eccentric portion for adjusting the position of the roller on said links as the shaft is rotated, an operating handle mounted for rotation and having a link rigidly connected to said handle and an operating bar connecting said handle link to the connecting bar to move the parallel bar linkage as the operating handle is turned and force the closure into a tightly closed position.

2. The dogging mechanism of claim 1, wherein the ramp has multiple slopes and the slope adjacent the plateau portion is the least steep.

3. The dogging mechanism of claim 1, wherein the connecting bar is pivotally connected to the pivotally mounted links inboard of the rollers.

4. The dogging mechanism of claim 1, wherein the operating bar has gimbal like pivoted end connections.

5. The dogging mechanism of claim 1, wherein there are two pairs of lugs; two pairs of links pivotally disposed so that there is a link cooperatively associated with each lug; each link having a roller disposed adjacent the end away from the pivot; a connecting bar connecting the two links in each pair forming a parallel bar linkage; the operating handle having a pair of links rigidly connected thereto and a pair of operating bars; each operating bar connecting one of the handle links to one of the connecting bars, whereby all of the rollers engage the cooperatively associated lug generally in unison and apply generally the same closing force on each lug.

6. The dogging mechanism of claim 5, wherein the rollers are mounted on shafts having eccentric portions, whereby the shafts can be rotated to adjust the position of the rollers on the links to provide generally equal loading on each lug.

* * * * *